US006439433B1

(12) United States Patent
Dubach et al.

(10) Patent No.: US 6,439,433 B1
(45) Date of Patent: Aug. 27, 2002

(54) POURING DEVICE

(75) Inventors: Werner Fritz Dubach, Maur; Anton Spaltenstein, Kloten, both of (CH); Niall English; Patrick Rigney, both of Dublin (IE)

(73) Assignees: UDV Operations Ireland Limited, Dublin (IR); Createchnic AG, Nurensdorf (CH)

( * ) Notice: Subject to any disclaimer, the term of this patent is extended or adjusted under 35 U.S.C. 154(b) by 0 days.

(21) Appl. No.: 09/402,486

(22) PCT Filed: Apr. 14, 1998

(86) PCT No.: PCT/IE98/00027

§ 371 (c)(1),
(2), (4) Date: Jan. 10, 2000

(87) PCT Pub. No.: WO98/46500

PCT Pub. Date: Oct. 22, 1998

(30) Foreign Application Priority Data

Apr. 14, 1997 (CH) ..... 0865/97
Aug. 27, 1997 (IE) ..... 970631

(51) Int. Cl.[7] ..... B67D 5/60
(52) U.S. Cl. ..... 222/145.3; 222/481.5
(58) Field of Search ..... 222/94, 129, 145.3, 222/145.5, 145.6, 481.5

(56) References Cited

U.S. PATENT DOCUMENTS

| | | | | |
|---|---|---|---|---|
| 2,204,524 A | | 6/1940 | Bender | 215/79 |
| 2,812,120 A | * | 11/1957 | Beall, Jr. | 222/481.5 |
| 5,601,217 A | * | 2/1997 | Wagner | 222/481.5 |

FOREIGN PATENT DOCUMENTS

| | | | | |
|---|---|---|---|---|
| CH | 674717 | | 7/1990 | |
| DE | 3919455 | * | 12/1989 | 222/481.5 |
| EP | 558470 | * | 9/1993 | 222/481.5 |
| FR | 1307009 | | 2/1963 | |
| FR | 2647093 | | 11/1990 | |
| WO | WO95/13230 | | 5/1995 | |

* cited by examiner

*Primary Examiner*—Joseph A. Kaufman
(74) *Attorney, Agent, or Firm*—Jacobson Holman, PLLC

(57) ABSTRACT

A pouring device for two individual, mutually connected containers include in each case a sealing bung on each container neck. The sealing bung has a pouring outlet and an incoming air orifice. Pouring elements, which each includes a chamber, are disposed above the sealing bung. A pouring orifice and an incoming air orifice issue into each chamber. A single connection line leads off from the chamber to a corresponding pouring outlet. The pouring elements can be attached to the container necks. A cover is placed over the pouring element and includes a thread bung onto which it is possible to screw a threaded over including a sealing part mounted therein.

18 Claims, 15 Drawing Sheets

POURING DEVICE

INTRODUCTION

The invention relates to a pouring device and in particular to a pouring device comprising two separate outlets for simultaneously pouring two liquids from two individual, mutually connected containers.

Pouring devices of this type are used in particular for dispensing two different liquids, in particular drinks, which are to be combined when dispensed. The fact that the liquids are guided separately renders it possible for the two pouring outlets to be of different sizes so that a desired mixing ratio can be achieved during the dispensing process. One such pouring device is described in WO 95/13230A.

There is a need for a pouring device of this type which is reliable and convenient in use and which is relatively cheap to manufacture. This invention is directed towards providing such a pouring device.

STATEMENTS OF INVENTION

According to the invention, there is provided a pouring device comprising a sealing bung for closing a container neck and a pouring spout leading from the sealing bung and having a spout pouring orifice, the sealing bung having a bung pouring orifice and an incoming air orifice, the bung pouring orifice and incoming air orifice issuing into a chamber which is sealingly disposed above the sealing bung, the chamber having a single delivery line through the pouring spout to the spout pouring orifice, the cross sectional area of the bung pouring orifice, being less than the cross sectional area of the delivery line and the spout pouring orifice.

In a preferred embodiment of the invention, the bung pouring orifice leads to a pouring passageway in the bung and the pouring passageway comprises a narrow section leading from the bung pouring orifice and a wider section for opening into a container neck.

In a particularly preferred embodiment of the invention, the chamber has a baffle means to provide some separation of outgoing liquid and incoming air streams within the chamber.

Preferably, the pouring spout has liquid flow directing means to direct the flow of liquid through the spout pouring orifice in a preferred direction. In this case, preferably the liquid flow directing means comprises rib means on a side wall of the pouring spout at least adjacent the spout pouring orifice.

In a preferred arrangement, the chamber is defined between the sealing bung and the pouring spout.

In another embodiment, the pouring spout is a separate part from the sealing bung and forms an extension thereof.

The pouring spout and sealing bung may be a single part.

In one particularly preferred embodiment of the invention, the pouring device comprises two separate sealing bungs and associated pouring spouts for two individual mutually connected containers each having a container neck, the pouring device being used for substantially simultaneous pouring of liquids from the individual containers.

Since the measurement tolerances with respect to the spacing of the container necks of the two containers are extremely great, it is advantageous to manufacture the two sealing bungs in each case as a separate, injection moulded part. This produces clear conditions for the other components of the pouring device which are to be added.

However, if it is possible for the distance between the container necks in all three directions in space to be maintained within relatively small limits, then the two sealing bungs can be mutually connected by way of at least one common cross-piece and can be injection moulded in one piece as a combined element.

Such containers are normally glass bottles whose bottle necks comprise relatively large tolerances with respect to the essential dimensions. Attempts have been made in the case of the known pouring devices to achieve the entire sealing and liquid guiding region as well as the attachment to the two bottle necks with one, essentially one-piece, element. In the case of the invention, however, in an advantageous manner the seal between the containers and the seal between the sealing bung and the continuous guiding elements of the pouring device are separate, in that each sealing bung comprises a cover surface which defines the depth of insertion and a circumferential, upwardly protruding sealing wall is disposed on said cover surface. In order to increase the sealing force of this sealing wall, said wall can extend in a conical manner, be radially resilient and be inclined upwardly and outwardly. In a manner known per se, the sealing bungs can be provided with tubes through which the air rises.

It is particularly advantageous if each sealing bung comprises a spout which is disposed in the extension of the pouring orifice and which protrudes into the chamber. This has the advantage that any residual quantities, which run back, can collect in the chamber without liquid residue drying out and block the pouring orifice itself. Moreover, this has provided itself hydrodynamically to be an extremely favourable solution.

Since the sealing and tolerance problems are no longer dependent upon the container neck, it is now possible to dispose on each sealing bung a one-piece pouring element in a sealing manner, which pouring element encompasses on the one hand the entire chamber and on the other hand the connection line and comprises means for holding onto the respective container neck. This is rendered possible owing to the fact that the entire construction can be performed on the sealing bung which is extremely dimensionally accurate and seals the container neck. The pouring elements on the sealing bung can also be combined as one-piece by way of at least one common, flexible-elastic cross-piece. As a consequence, only a single component is produced for assembly.

The connection members for the purpose of connecting the pouring elements to the container neck are designed in an advantageous manner as resilient, radially inwardly and upwardly directed latching laminae. This design form enables the largest possible tolerances to be bridged.

For the purpose of sealingly connecting the pouring elements to the sealing bung, an annular groove which extends around the chamber is provided on the pouring element in an advantageous manner and the circumferential sealing wall fits in a sealing manner into said annular groove.

In order to be able to avoid having to weld the connection line to the chamber, it is advantageous for ease of manufacture to design the connection lines in each case extending in a spiral-like manner with a constant radius. In this manner, the connection lines can each be manufactured by virtue of a single threaded slide. If the two pouring elements are manufactured, as mentioned above, combined, then the two connection lines are disposed in an advantageous manner extending in a spiral-like manner in a counter direction, which enables the two slides to be actuated simultaneously.

For aesthetic and stability reasons, the two container necks are preferably covered by a common cover which accommodates both the container necks, the sealing bungs, the chambers and the connection lines which issue with their outlet orifices into an integral threaded bung.

Finally, a threaded cover can be disposed on such a threaded bung. In order to render it possible for a single threaded cover to close two outlets simultaneously, an inner sealing plate is for example provided for the two pouring outlets, which said inner sealing plate comprises two sealing bungs and is mounted in such a manner as to be able to rotate in said cover whilst being held therein in a positive-locking but releasable manner. In order that such a threaded cover can be closed easily in an advantageous manner at least one positioning element is to be provided on the sealing plate which can cooperate with a likewise complementary element on the cover.

BRIEF DESCRIPTION OF THE DRAWINGS

The invention will be more clearly understood from the following description of some embodiments thereof, given by way of example only, with reference to the accompanying drawings, in which.

DETAILED DESCRIPTION

Figure 1:
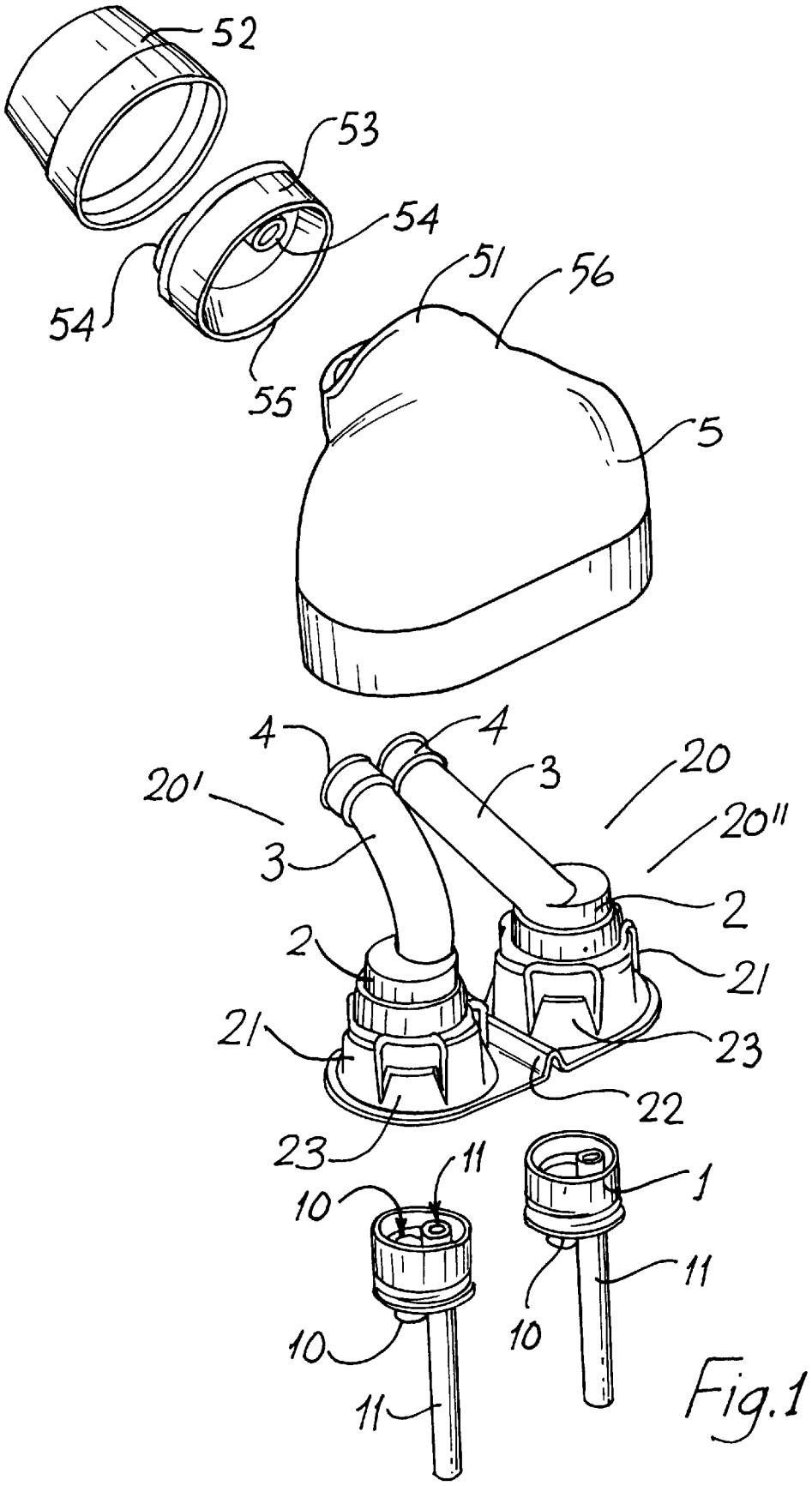
FIG. 1 is an exploded perspective view of a pourer according to one embodiment of the invention.
Figure 2:
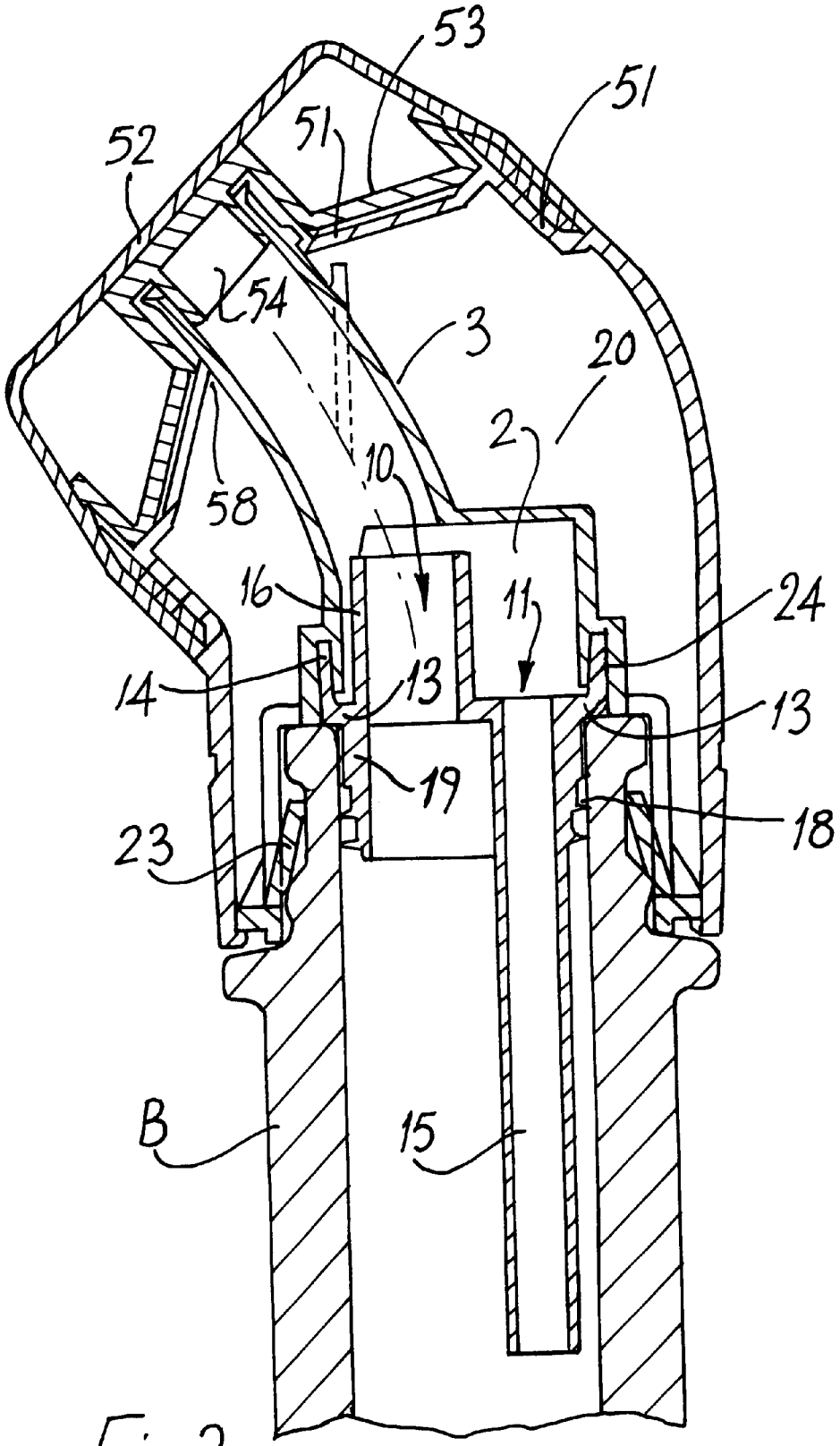
FIG. 2 is a vertical cross-sectional view through the assembled pourer.
Figure 3:
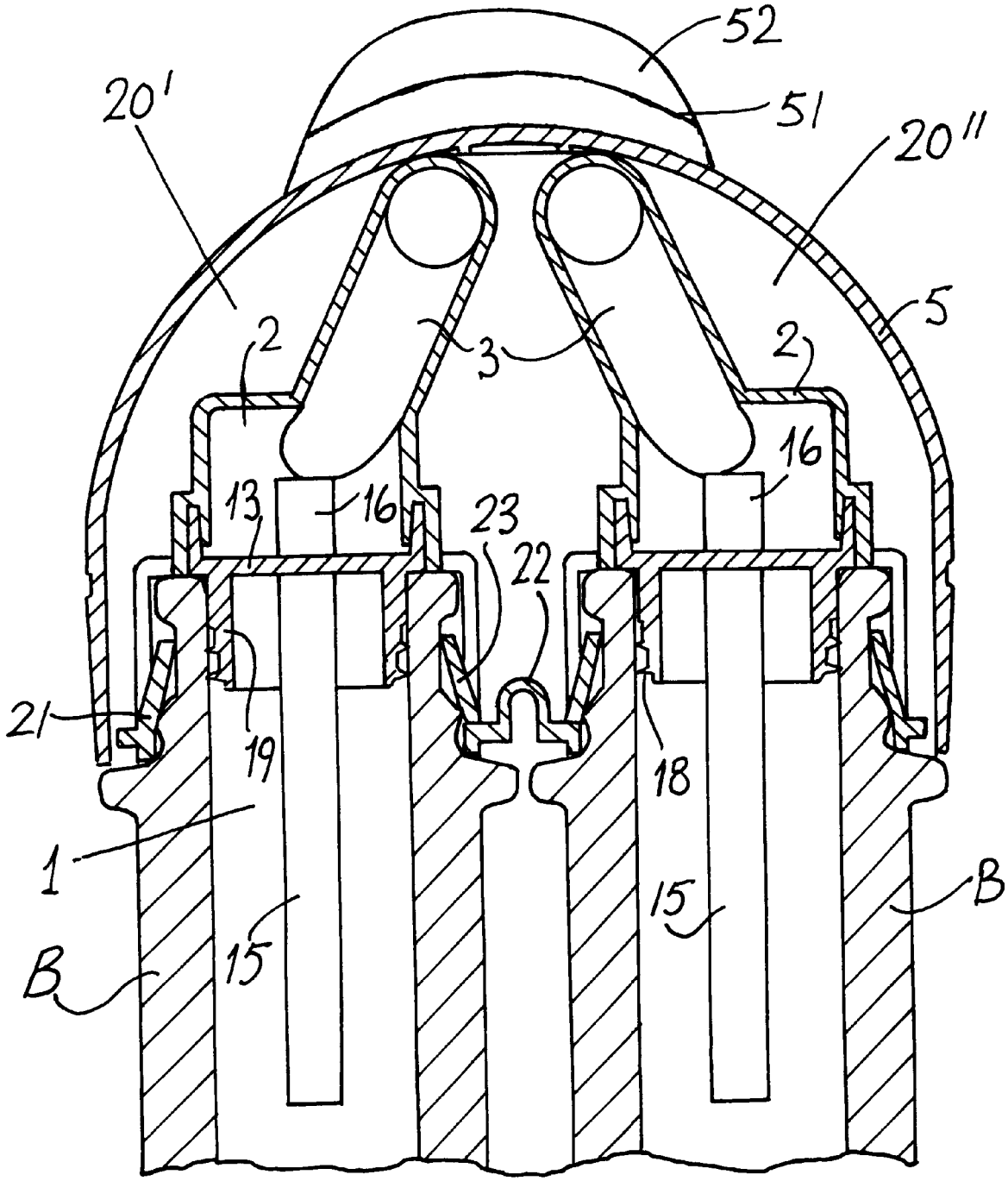
FIG. 3 is a vertical cross-sectional view of the pourer in the common central plane of the necks of containers to which the pourer is fitted.

Referring initially to FIGS. 1 to 3, the two individual, mutually connected containers each comprise a container neck B are each evident at least partially only in FIG. 3. An illustration of the entire containers was intentionally omitted since the design thereof and the manner in which they are connected are not significant for the connection. The special design of the container neck is also of no significance for the purpose of implementing the inventive idea. The container neck illustrated here corresponds to a standard bottle neck, whereby the illustration is intended merely to show that for the principle of the invention the design of the bottle neck is likewise of no importance. The corresponding solution can be adopted to any form of container neck B without abandoning the principle according to the invention.

For the purpose of explaining individual parts and elements of the pouring device according to the invention reference is preferably made to FIG. 1, whilst with regard to the manner in which the individual parts of the pouring mechanism cooperate with each other reference is made to the other two FIGS. 2 and 3.

A sealing bung is inserted in a sealing manner into each container neck B. The sealing bungs 1 have the form of a hollow cylinder comprising a base. Circumferential sealing ribs 18 are provided on the outer surface of the cylindrical wall 19. Two through-going orifices penetrate the base, not clearly visible in the drawing, or the cover surface 13. The orifice with the larger cross-section is a pouring orifice 10, whereas the through-going orifice with the smaller diameter is an incoming air orifice 11. The pouring orifice 10 comprises an upwardly directed spout 16, whereas the incoming air orifice 11 is provided with an air tube 15 which protrudes into the corresponding container neck B. The air tube 15 is considerably longer than the spout 16. This is necessary owing to the flow characteristics and guarantees that the liquid does not flow through the air tube 15 but rather only flows through the spout 16 of the pouring device 10.

With regards to the exact design of the two sealing bungs 1 reference is made to the cross-sectional views in FIGS. 2 and 3. The base and cover surface 13 of the sealing bung 1 are shown in FIG. 3. Since the vertical cross-section according to FIG. 3 extends precisely between the spout 16 and the incoming air orifice 11, the cover surface 13 in this illustration appears closed. The cylindrical wall 19 is visible below the cover surface 13. This wall represents the part of the sealing bung 1 which penetrates the container neck B. Since the cover surface 13 protrudes in a radial manner beyond the cylindrical wall 19, it also defines the depth of insertion of the sealing bung 1 by engaging a top of the neck B of the bottle. The cover surface 13 is provided towards the top with a peripheral circumferential sealing wall 14. This circumferential sealing wall 14 extends inclined upwards and outwards in a conical manner and can therefore have a slight radially resilient effect. In principle, the two sealing bungs 1 on the container necks are identical construction with the cross sectional areas of the spouts 16 being varied as required to control the flow rate of liquid from each bottle.

A chamber 2 is disposed over each sealing bung 1. Two through-going orifices issue into the chamber 2, namely both the pouring orifice 10 and also the incoming air orifice 11. The chamber 2 is of such a height that it protrudes beyond the spout above the pouring orifice 10. The chamber 2 is part of a pouring element 20 which in addition to the chamber 2 also comprises a pipe or connection line 3 and connection means 21 for holding onto the container neck B. In the solution illustrated here, a pair of pouring elements 20', 20" are mutually connected by way of an elastic cross-piece 22. This has the advantage that only one element need be injection moulded, the relative position of the two pouring elements with respect to each other is fixed, wherein the elasticity of the common, flexible-elastic cross-piece 22 provides the necessary adaption to suit the irregularities in the measurements of the two container necks B and in each case provides a bridge for same.

Each dome-shaped chamber 2, which is part of the pouring element 20 comprises a circumferential annular groove 24 into which the circumferential sealing wall 14 of the sealing bung 1 engages in a sealing manner. The connection means 21, which holds the container neck B in a positive and non-positive locking manner ensures that the pouring element 20 is held in the proper position on the container neck B. The relatively delicate, sealing connection of the chamber 2 to the container neck B is thus indirectly solved, in that the connection is formed in a sealing manner between the upwardly protruding sealing wall 14 of the sealing bung 1 and the circumferential annular groove 24 around the chamber 2 of the pouring element 20. This seal is merely provided between the two mutually corresponding synthetic material parts, whereas the large irregularities with regard to the measurements on the bottle can be compensated by means of the connection means 21. Accordingly, the connection means 21 are designed as radially inwardly and upwardly directed latching laminae 23. These resilient laminae can compensate without any problem any deviations in measurements at the container neck B.

As already mentioned, a connection line 3 is also part of the pouring element 20. The connection line 3 comprises a diameter which remains at least approximately constant over its entire length and extends in a spiral shape. In so doing, the radius of the spiral remains constant. This has particular advantages with regard to tooling in that in this manner, the inner space of the connection line 3 can be screwed in and out by virtue of a rotatable slide. In the case of the solution illustrated here, in which two pouring elements 20 are mutually connected by way of a cross-piece 22, it is possible in this manner to dispose the connection lines 3 counter-direction spiral-shape [sic]. It is possible by means of a single drive to move the rotatable slides as one in and out. This reduces the tooling costs considerably.

From the point of view of mere functionality, it is sufficient if the pouring device consists of the sealing bung 1 and the pouring elements 20. Outlet orifices 4 of the connection lines 3 can be closed individually by means of known closure devices. However, such a solution is lacking both aesthetically and as far as comfort is concerned. Accordingly, a cover 5 is provided which is snapped over the upper region of the container necks B, the two sealing bungs 1 and the common pouring element 20', 20". This not only has an aesthetic effect but the delicate connection lines 3 are also protected in an optimum manner. The cover 5 itself comprises an integral bung 51 having two holes 58 in which the outlet orifices 4 of the two connection lines 3 are received in a positive-locking manner. The integral bung 51 is achieved in this case as a threaded bung on which a threaded cover 52 can be placed. Since it is normally not possible to close two eccentric orifices simultaneously with one threaded cover, a special feature in this case is an inner sealing plate 53 which is mounted in the threaded cover 52 in such a manner as to be able to rotate yet is held therein in a positive-locking but releasable manner. This sealing plate 53 remains in the threaded cover 52 once it has been pushed therein. The sealing plate 53 is provided with two sealing bungs 54 for the two pouring outlets 4. When screwing the threaded cover 52 onto the integral threaded bung 51 of the cover 5, the sealing plate 53 initially rotates with the threaded cover 52 until it has moved so close to the threaded bung 51 that the two sealing bungs 54 begin to engage in the pouring outlets 4. The angular position of the sealing plate 53 then no longer changes with respect to the threaded bung, while the threaded cover 52 rotates about the sealing plate 53. In so doing, the sealing plate 53 now only performs a translatory movement. The most convenient manner of achieving this positioning is to dispose on the sealing plate 53 a positioning element which cooperates with a similar complementary element on the cover 5. In this most simplest case, it is sufficient that the end edge 55 fits the contour line 56 around the threaded bung 51 of the cover 5 in a positive-locking manner. In this case, the correct positioning of the sealing plate 53 relative to the cover 5 is achieved at the time of placing on the threaded cover 52.

Although not illustrated in the drawing, it is completely clear that different variations of the inventive idea are possible. Accordingly, the two sealing bungs 1 can be formed like the pouring elements 20 in one piece mutually connected by way of a corresponding elastic cross-piece. In the case of variants of this type, however, the pouring elements 20' and 20" are then likely to be separate, i.e. without connection by means of an elastic cross-piece. Moreover, with regard to the design of the cover 5, the designer has almost complete freedom which can also extend as far as the cover 5 being manufactured from two individual parts or mutually connected. Also, the design of the two spiral-shaped connection lines 3 must in no way automatically be of a spiral shape. The design form preferred in this case has a direct correlation with the design form of the cover 5. At the same time, optimum use of tools is to be achieved during the shaping process. This is achieved in the case of the solution illustrated. Above all, it is of importance for the invention that both the pouring orifice 10 and also the incoming air orifice 11 of the same sealing bung 1 issue into a common chamber 2, from which issues a single connection line 3 leading to the corresponding pouring outlet. Because the cross-sectional area of the connection line 3 is greater than the cross-sectional area of the pouring outlet 10, the exiting liquid cannot completely fill the connection line 3. In this manner, it is ensured that the incoming air can also flow through the same connection line 3 in the counter direction towards the incoming air orifice 11. In this manner, large cross-sections are provided which hardly become blocked and the incoming air orifice because neither tacky nor, less likely, contaminated, since it does not come into contact with the external environment. As a result of the special design of pouring outlet, any residual quantities can always flow back by way of the connection line 3 of the chamber 2 and the pouring outlet 10 into the container B. There is absolutely no problem if the medium can flow back into the container via the incoming air orifice 11 because after closing by means of the threaded cover 52 and the sealing plate 53, it occurs in the region in which the pressure is at saturation vapor pressure.

It is also interesting in this case that the entire system is designed such that high pressure in the containers automatically leads to an increase in the sealing pressure.

Figure 4:
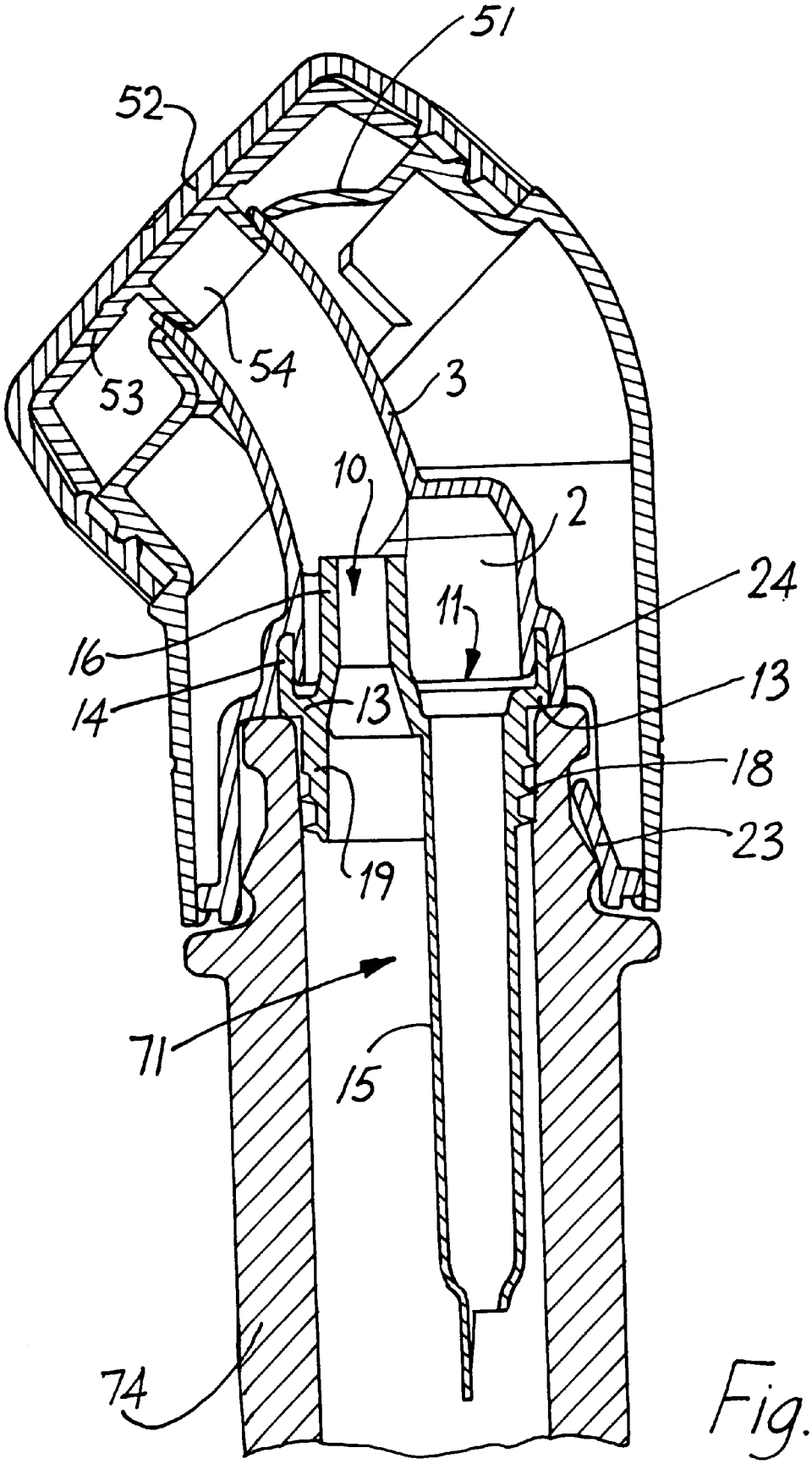
FIG. 4 is a vertical cross-sectional view through an assembled pourer according to another embodiment of the invention.
Figure 5:
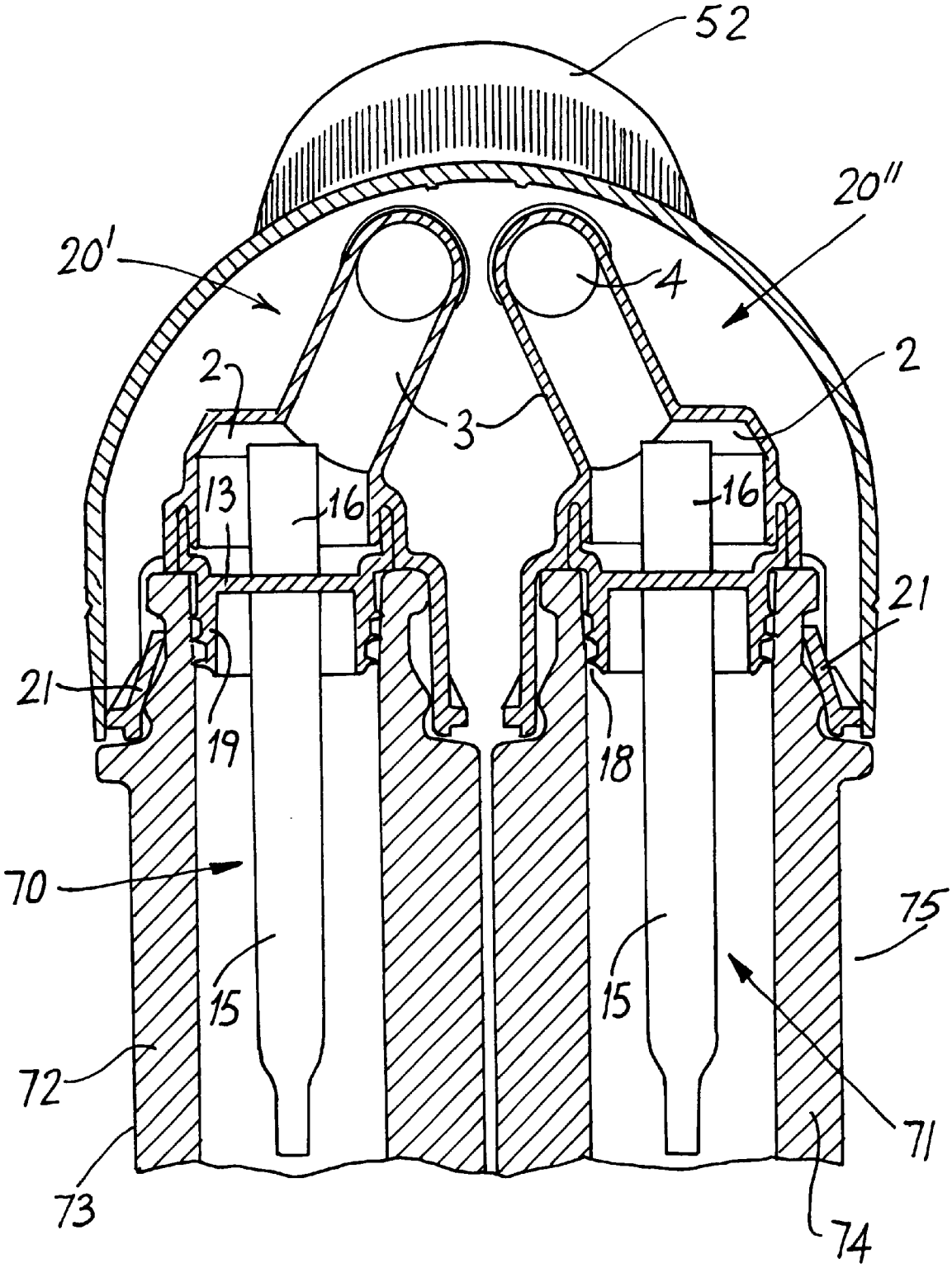
FIG. 5 is a vertical cross-sectional view of the pourer of FIG. 4 in the common central plane of the necks of the containers to which the pourer is fitted.
Figure 6:
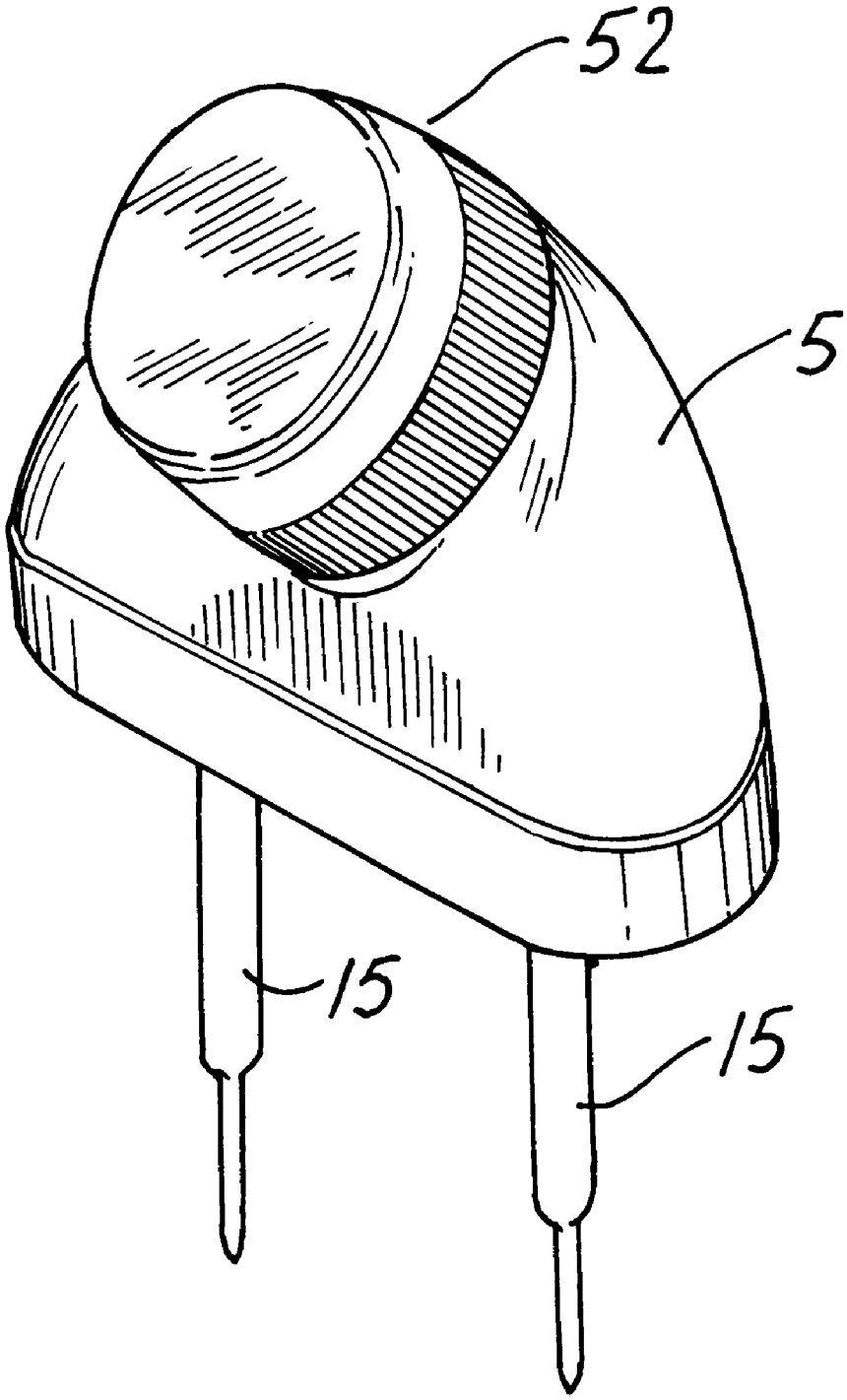
FIG. 6 is a perspective view of another pourer.
Figure 7:
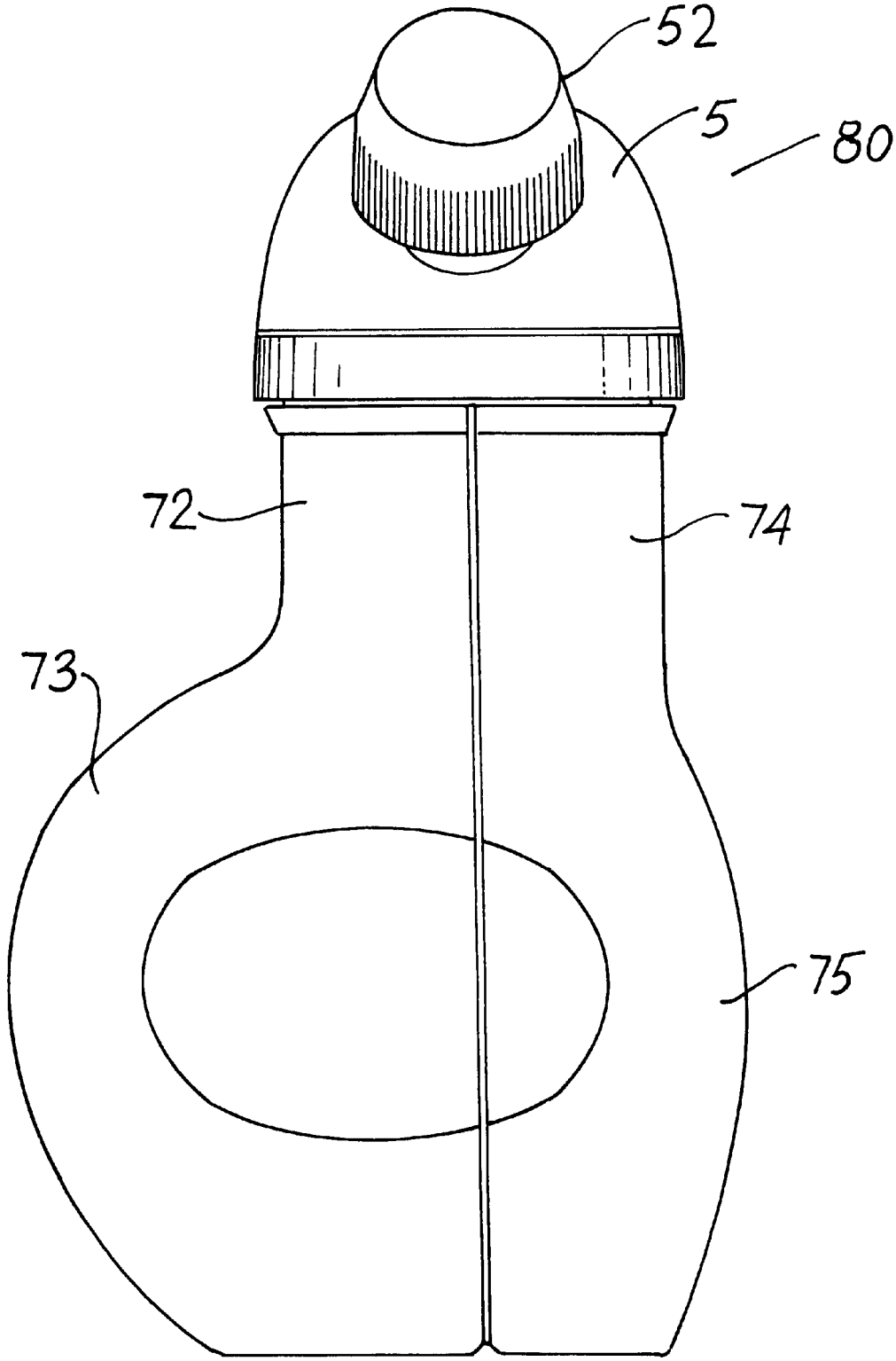
FIG. 7 is a front elevational view of the pourer of FIG. 6 mounted on an associated pair of containers.
Figure 8:
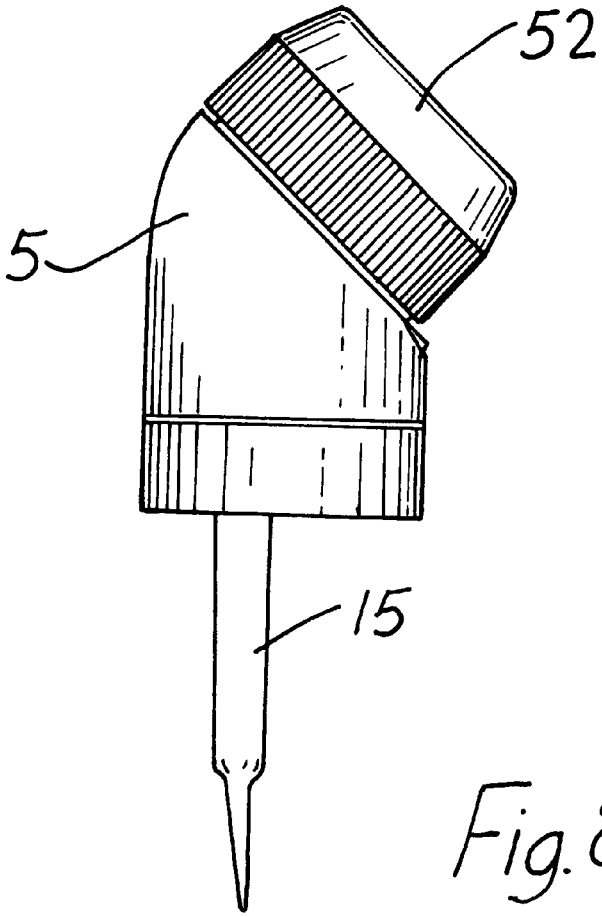
FIG. 8 is a side elevational view of the pourer of FIG. 6.
Figure 9:
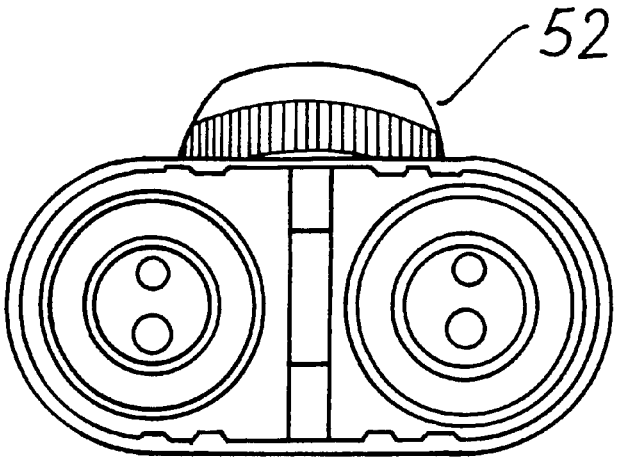
FIG. 9 is an underneath plan view of the pourer of FIG. 6.
Figure 10:
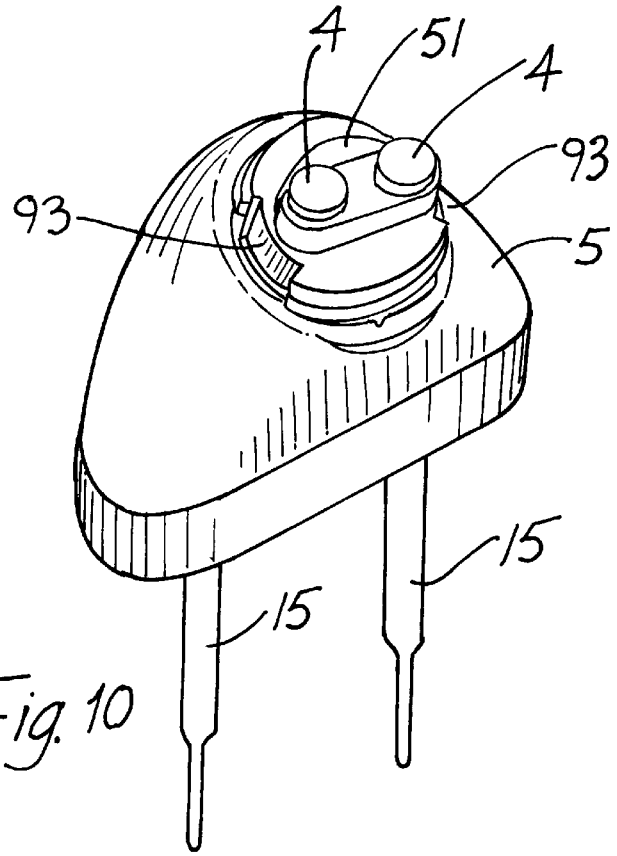
FIG. 10 is a perspective view of the pourer of FIG. 6 with a cap of the pourer removed.
Figure 11:
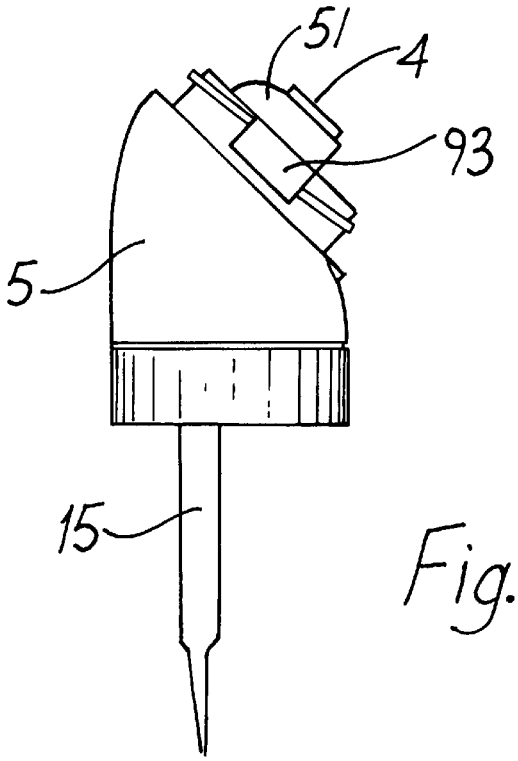
FIG. 11 is a side elevational view of the pourer of FIG. 6 with the cap removed.
Figure 12:
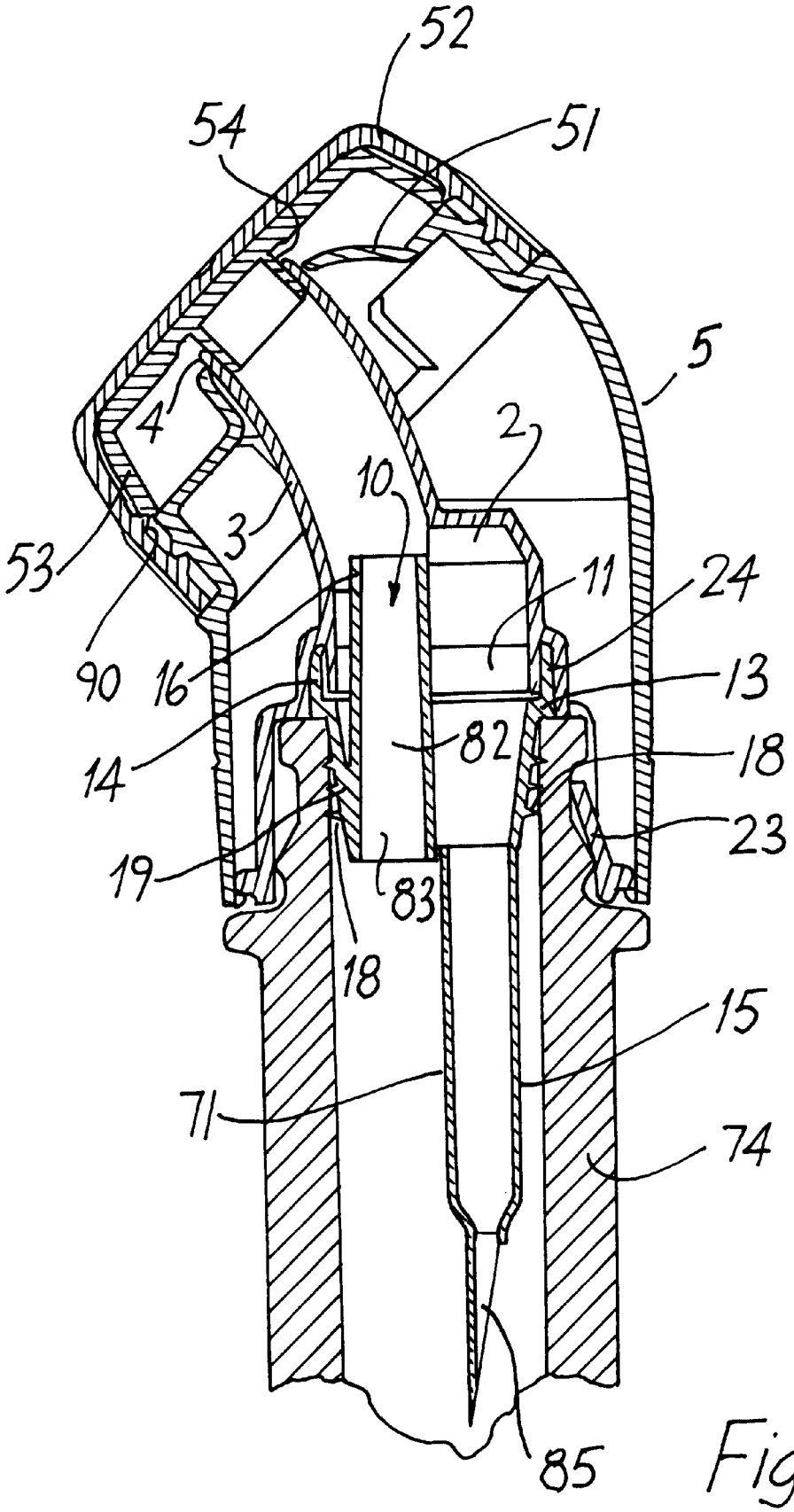
FIG. 12 is a vertical cross-sectional view through the pourer.
Figure 13:
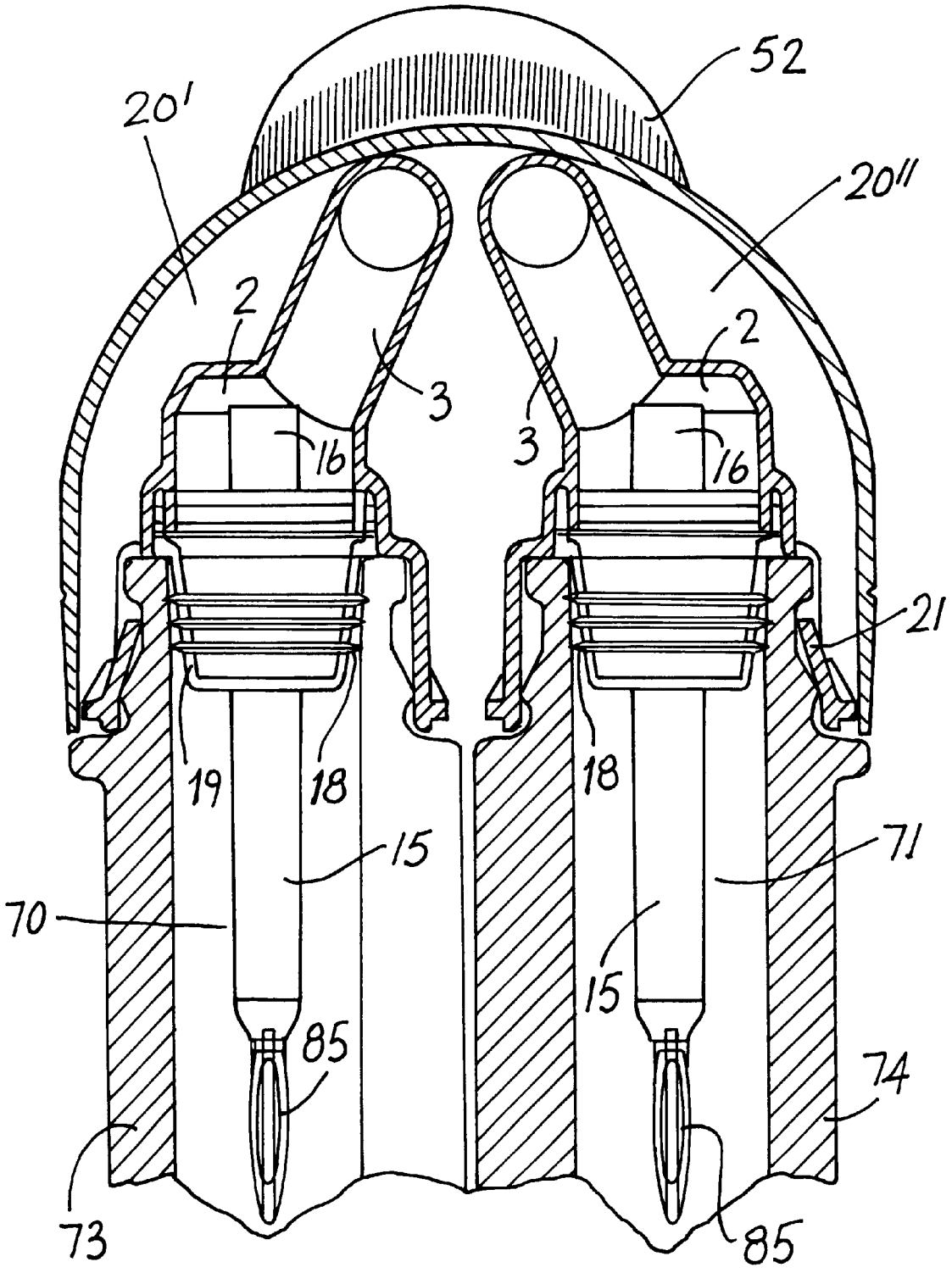
FIG. 13 is a vertical cross-sectional view of the pourer of the common central plane of the necks of the containers to which the pourer is fitted.
Figure 14:
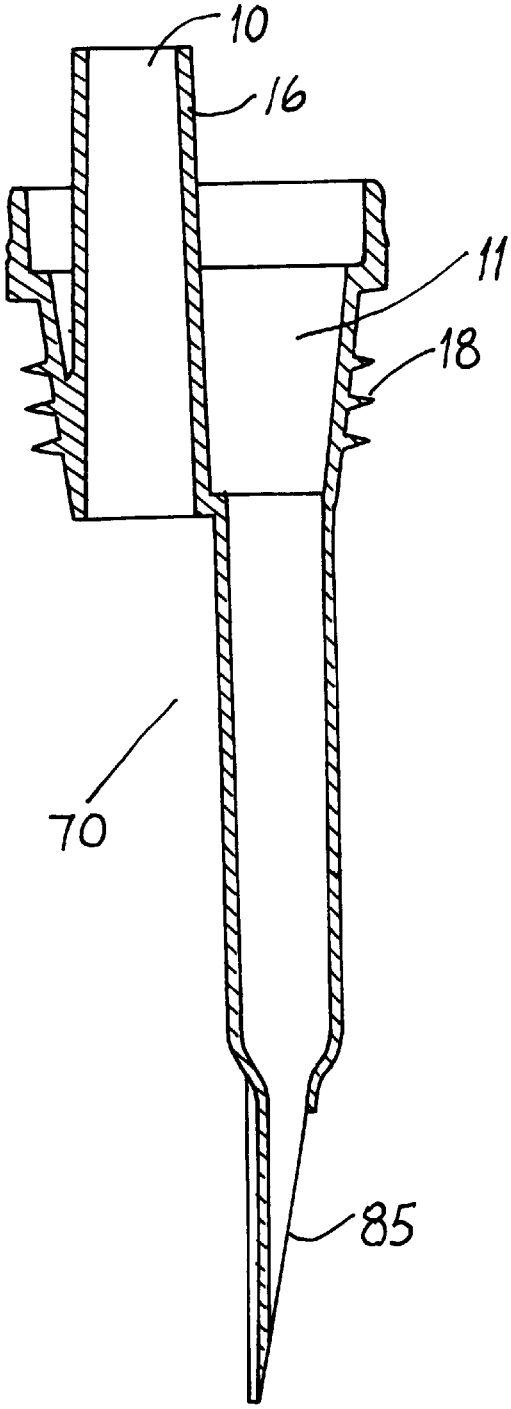
FIGS. 14 and 15 are sectional elevational views of sealing bungs forming portion of the pourer of FIG. 6.
Figure 15:
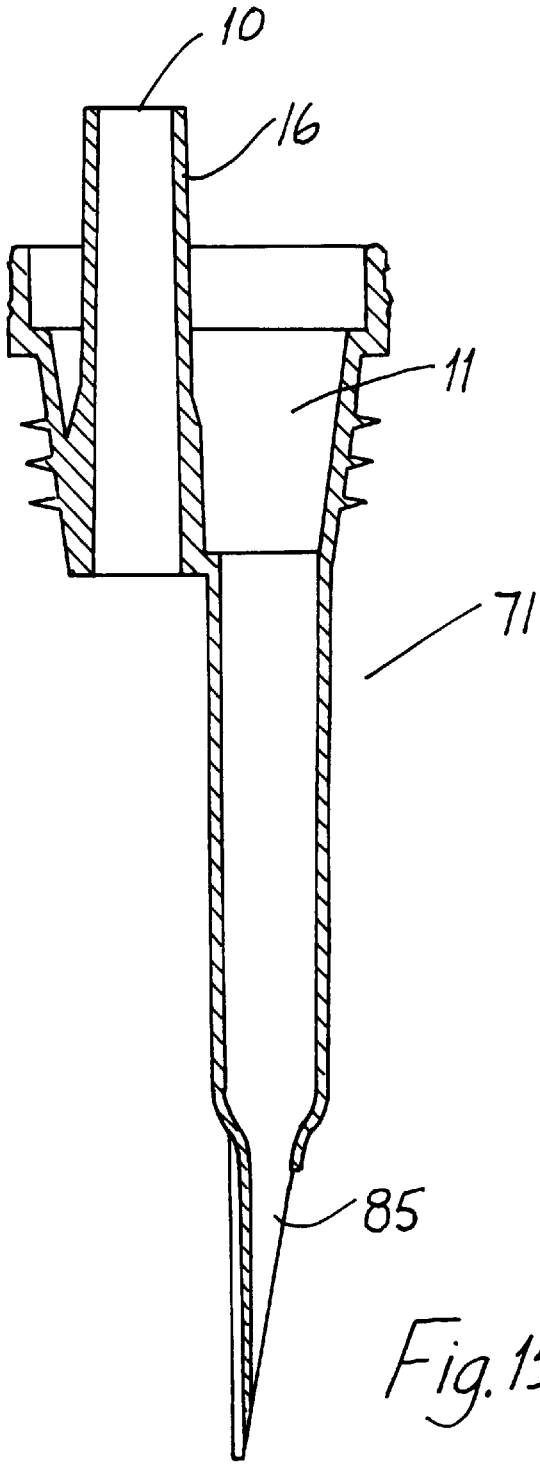
Figure 16:
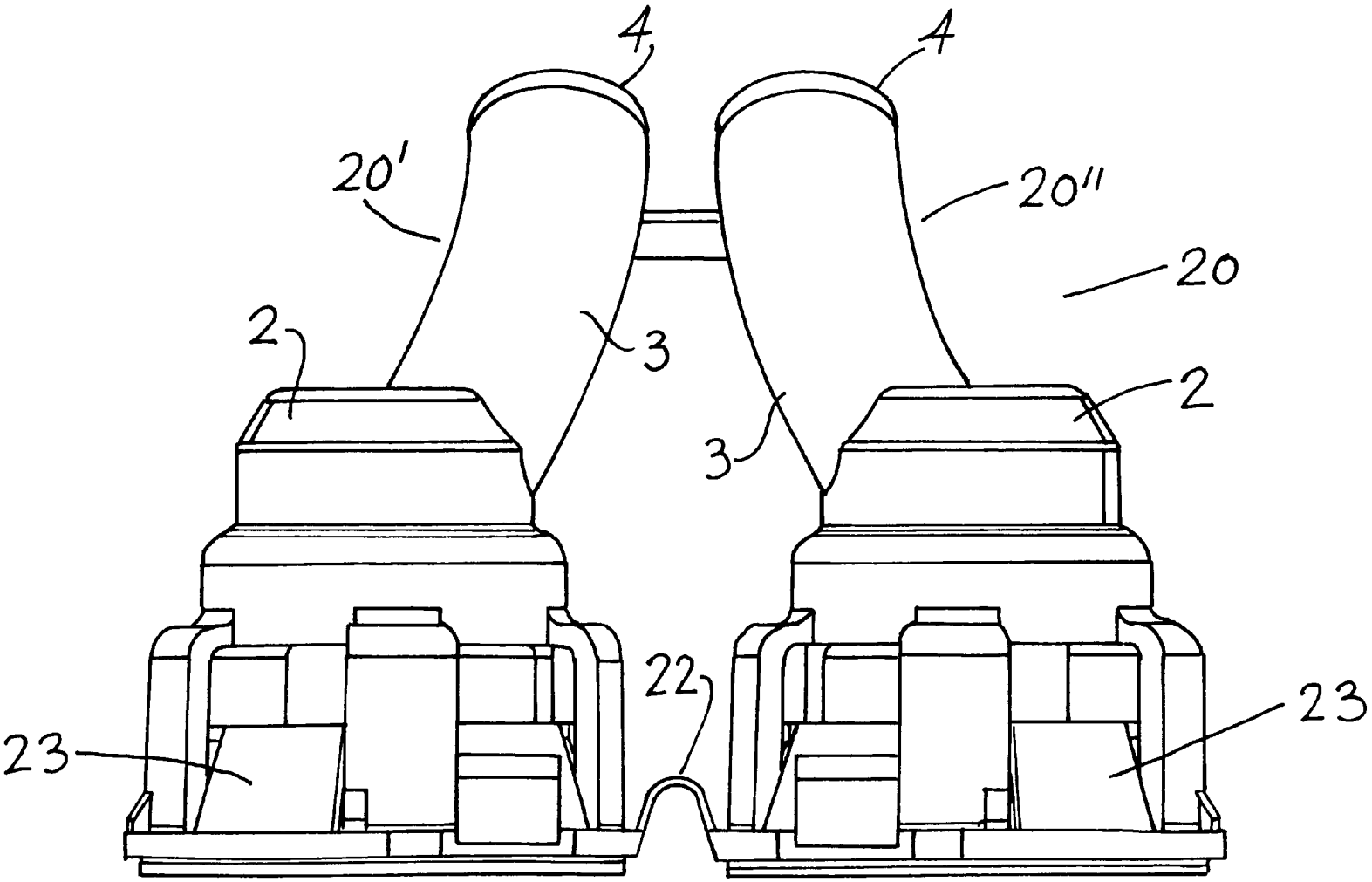
FIG. 16 is an elevational view of a spout portion of the pourer of FIG. 6.

Referring to FIGS. 4 and 5, there is illustrated a pouring device according to another embodiment of the invention. The pouring device is similar to the pouring device of FIGS. 1 to 3 and like parts are assigned the same reference numerals. The most significant differences are described below.

In this case, there are two separately moulded different sealing bungs 70, 71. The sealing bung 70 is particularly for sealing the neck 72 of a larger container 73 which in this case holds a dark colored liqueur. The sealing bung 71 is particularly for sealing the neck 74 of a smaller container 75 which in this case holds a white colored liqueur.

To assist in controlling the flow of the liquids, it will be noted that the pouring passageway of both sealing bungs 70, 71 is tapered having a narrow section leading from the bung pouring orifice 10 and a wider section for opening into the respective container neck 72, 74.

Each of the chambers 2 may be provided with a baffle to provide some separation of the outgoing liquid and incoming air streams within the chamber 2. This assists in achieving laminar flow of the liquid and in preventing glugging.

Each of the connection line 3 passageways leading to the outlets 4 has directing means to promote the formation of divergent liquid streams when the liquids emerge substantially simultaneously from the outlets 4, on pouring. In this case, the directing means comprises ribs along the inner surface of the connection lines 3 which direct the flow of liquid within the connection lines 3 so that when the liquid streams emerge, they are directed into divergent paths. This assists in keeping the liquid streams separate as they are poured. For example, the streams may be directed to different locations in a receptacle such as generally opposite locations in a glass side wall.

Referring now to FIGS. 6 to 20 there is illustrated another pourer according to the invention indicated generally by the reference numeral 80. Parts similar to those described previously are assigned the same reference numerals. Each bung 70,71 has a spout 16 with a tapered liquid pouring passageway 82 with a wide lower end 83 and a narrow upper end terminating in the pouring orifice 10. It will also be noted that an air outlet opening 85 at a lower end of the air tube 15 faces away from the outlet orifice 4 towards an upper most portion of the neck 72,74 of the container 73,75 when in the inclined pouring position.

Figure 17:
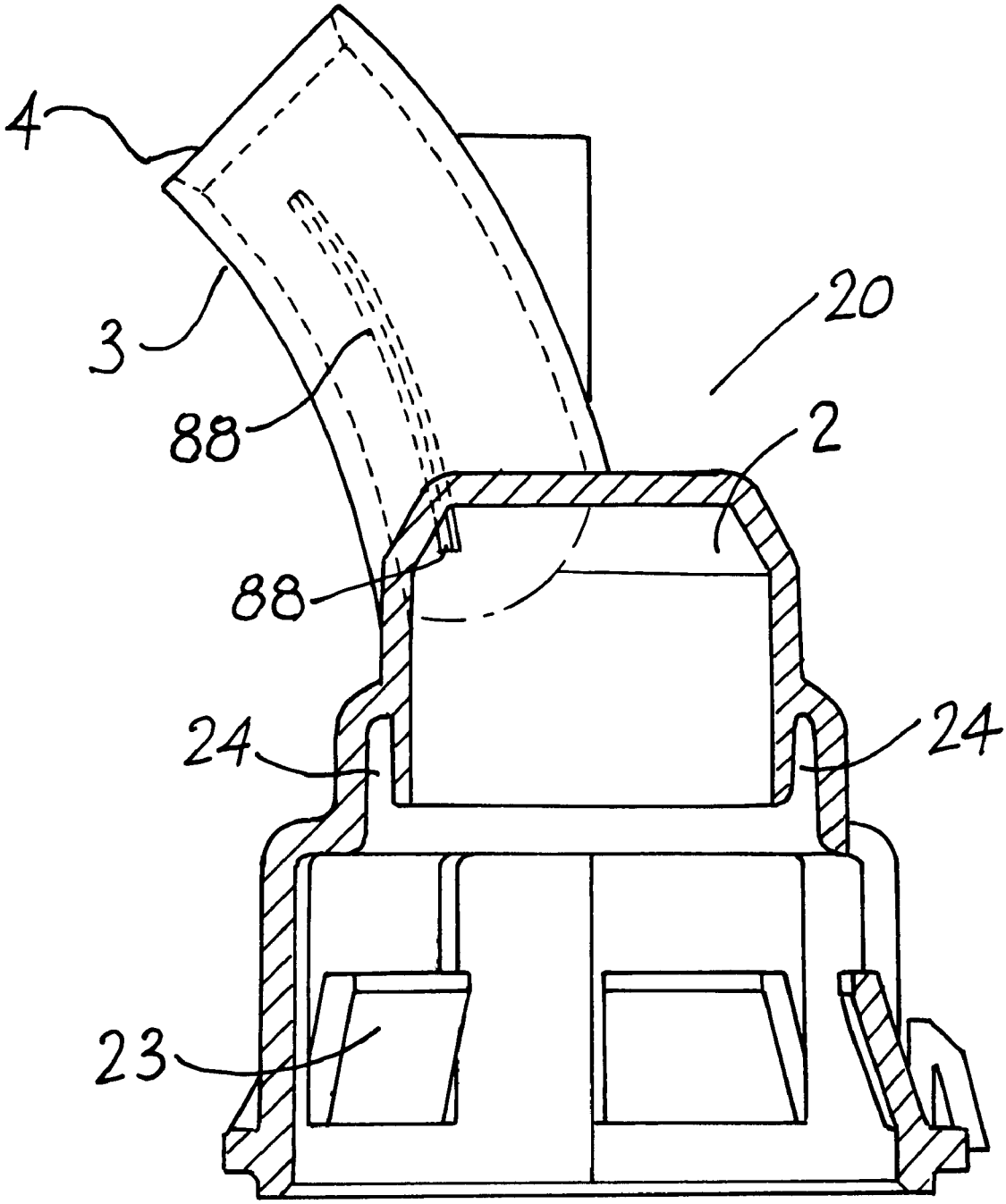
FIG. 17 is a sectional elevational view of the spout.

Referring to FIG. 17, each connection line 3 has a radial rib 88 along the inner surface of the connection line 3 for direction of the flow of liquid within the connection lines 3 so that when the liquid streams emerge they are directed into divergent paths.

Figure 18:
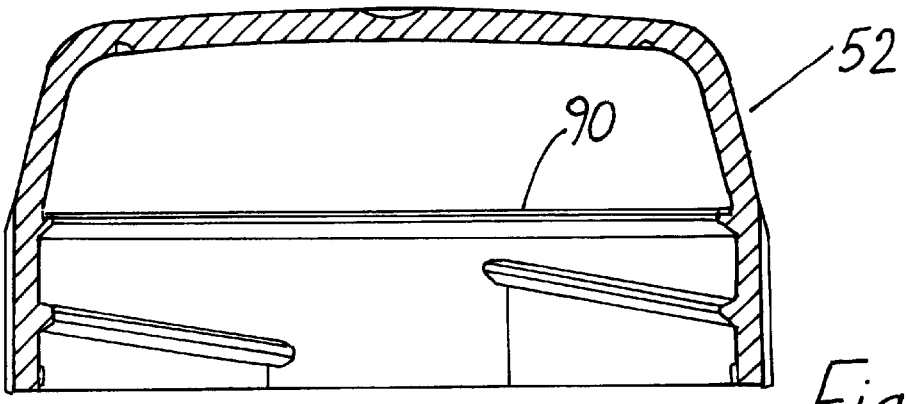
FIG. 18 is a sectional elevational view of a cap of the pourer of FIG. 6.
Figure 19:
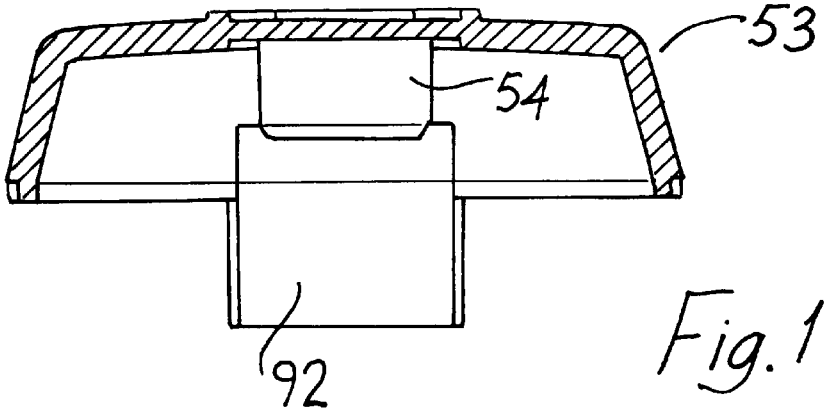
FIG. 19 is a side sectional elevational view of an inner sealing plate of the cap.
Figure 20:
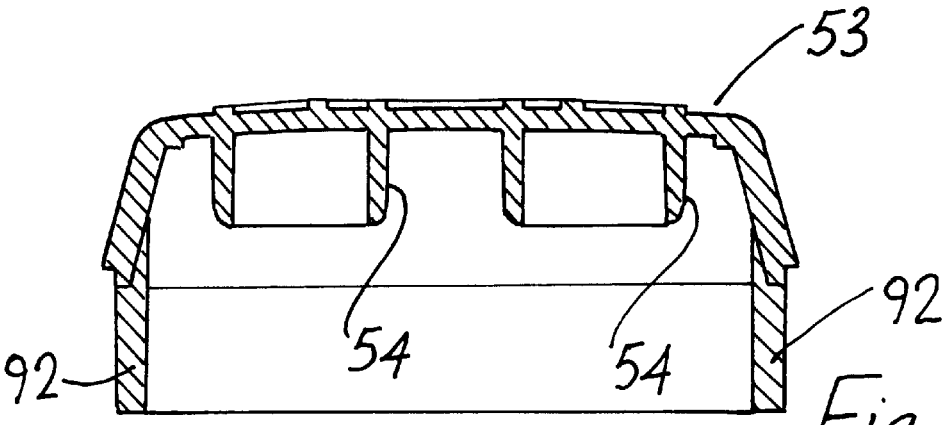
FIG. 20 is a sectional elevational view of the inner sealing plate.

Referring particularly to FIGS. 18 to 20 the cover 52 has an internal retaining lip 90 behind which the inner sealing plate 53 is retained. The inner sealing plate 53 is simply snapped into place behind the lip 90 and is free to rotate within the cover 52. At opposite sides of the inner sealing plate 53 downwardly depending engagement arms 92 are provided. These engagement arms 92 are engageable with complementary receiver slots 93 at opposite sides of the cover bung 51 (see FIG. 10) to correctly align the sealing bungs 54 with the outlet orifices 4 of the connection lines 3 of the pouring elements 20. Thus when mounting the cover 52 on the cover bung 51 the arms 92 engage within the slots 93 so that the sealing plate 53 will only perform a translatory movement guiding the sealing bungs 54 into sealing engagement within the outlet orifices 4.

It will be appreciated that while the pouring devices of the invention have been described in the context of substantially concurrent pouring of different liquids, the principles involved may in some cases be applied to produce a more efficient pouring device for a single liquid stream.

The invention is not limited to the embodiments hereinabove described which may be varied in construction and detail.

What is claimed is:

1. A pouring device comprising a pair of sealing bungs for closing the necks of a two-part container, a pouring spout leading from each sealing bung and having a spout pouring orifice, each sealing bung having a bung pouring orifice and an incoming air orifice, the bung pouring orifice and incoming air orifice issuing into a chamber which is sealingly disposed above the sealing bung, the chamber having a single delivery line through the pouring spout to the spout pouring orifice, the cross-sectional area of the bung pouring orifice being less than the cross sectional area of the delivery line and the spout pouring orifice, the single delivery line extending in a spiral shape through the pouring spout and having a substantially constant radius, the single delivery line in each bung of the pair of sealing bungs extending in a counter direction in a spiral shape.

2. A pouring device as claimed in claim 1, wherein each bung pouring orifice leads to a pouring passageway in the bung and the pouring passageway comprises a narrow section leading from the bung pouring orifice and a wider section for opening into the container neck.

3. A pouring device as claimed in claim 1, wherein the chamber has a baffle means to provide some separation of outgoing liquid and incoming air streams within the chamber.

4. A pouring device as claimed in claim 1, wherein each pouring spout has liquid flow directing means to direct the flow of liquid through the spout pouring orifice in a preferred direction.

5. A pouring device as claimed in claim 4, wherein the liquid flow directing means comprises rib means on an inner side wall of the pouring spout at least adjacent the spout pouring orifice.

6. A pouring device as claimed in claim 1, wherein the chamber is defined between the sealing bung and the pouring spout.

7. A pouring device as claimed in claim 1, wherein each sealing bung is in each case a single element which is made from synthetic material.

8. A pouring device as claimed in claim 1, wherein the pair of sealing bungs are mutually connected by way of at least one common cross-piece and are manufactured in one piece as a combined element.

9. A pouring device as claimed in claim 1, wherein each sealing bung comprises a cover surface which defines the depth of insertion and on which is disposed a circumferential upwardly protruding sealing wall.

10. A pouring device as claimed in claim 9, wherein the circumferential sealing wall extends conically in a radially resilient manner inclined upwards and outwards.

11. A pouring device as claimed in claim 9, wherein each pouring spout including a circumferential annular groove about the chamber into which groove the circumferential sealing wall of the corresponding sealing bung fits in a sealing manner.

12. A pouring device as claimed in claim 1, wherein in each sealing bung the incoming air orifice comprises an air tube which protrudes into the respective container neck.

13. A pouring devices as claimed in claim 1, wherein in each sealing bung is provided a spout which protrudes into the chamber.

14. A pouring device as claimed in claim 1, wherein each pouring spout includes connection means for the purpose of holding the pouring spout on the respective container neck.

15. A pouring device as claimed in claim 14, wherein the two pouring spouts which are connected to the pair of sealing bungs are combined into one piece by way of at least one common, flexible-elastic cross-piece.

16. A pouring device as claimed in claim 14, wherein the connection means are resilient latching laminae which are directed radially inwards and upwards.

17. A pouring device comprising a pair of sealing bungs for closing the necks of a two-part container, a pouring spout leading from each sealing bung and having a spout pouring orifice, each sealing bung having a bung pouring orifice and an incoming air orifice, the bung pouring orifice and incoming air orifice issuing into a chamber which is sealingly disposed above the sealing bung, the chamber having a single delivery line through the pouring spout to the spout pouring orifice, the cross-sectional area of the bung pouring orifice being less than the cross-sectional area of the delivery line and the spout pouring orifice, a liquid delivery line extending in a spiral shape through each pouring spout and having a substantially constant radius.

18. A pouring device comprising a pair of sealing bungs for closing the necks of a two-part container, a pouring spout leading from each sealing bung and having a spout pouring orifice, each sealing bung having a bung pouring orifice and an incoming air orifice, the bung pouring orifice and incoming air orifice issuing into a chamber which is sealingly disposed above the sealing bung, the chamber having a single delivery line through the pouring spout to the spout pouring orifice, the cross-sectional area of the bung pouring orifice being less than the cross-sectional area of the delivery line and the spout pouring orifice wherein on each sealing bung is disposed in a sealing manner the pouring spout which comprises said chamber and the connection line and comprises connection means for the purpose of holding onto the respective container neck, said connection means comprising resilient latching laminae which are directed radially inwards and upwards.

* * * * *